United States Patent [19]

Nickell

[11] 3,995,403

[45] Dec. 7, 1976

[54] CONSTRUCTION MODULE AND STRUCTURES ASSEMBLED THEREFROM

[76] Inventor: Marvin E. Nickell, 12504 Chippewa Lane, Burnsville, Minn. 55337

[22] Filed: June 26, 1975

[21] Appl. No.: 590,408

[52] U.S. Cl. ..... 52/284; 52/493; 52/580; 52/619; 52/664; 52/732

[51] Int. Cl.[2] ..... E04C 2/38; E04B 2/28

[58] Field of Search ..... 52/624–630, 52/578–581, 294, 758 C, 479, 481, 493, 281, 584, 619, 384, 586, 495, 620, 732, 614, 284, 664; 108/53–55

[56] References Cited

UNITED STATES PATENTS

| | | | |
|---|---|---|---|
| 1,941,483 | 1/1934 | Moorman | 108/55 |
| 1,983,020 | 12/1934 | De Vol | 52/384 |
| 2,071,666 | 2/1937 | Sylvan | 52/284 |
| 2,137,767 | 11/1938 | Betcone | 52/495 |
| 2,640,669 | 6/1953 | Ashford | 52/625 |
| 3,001,613 | 9/1961 | McBerty | 52/580 |
| 3,841,047 | 10/1974 | Zinn | 52/732 |

FOREIGN PATENTS OR APPLICATIONS

| | | | |
|---|---|---|---|
| 1,190,872 | 4/1959 | France | 52/479 |

*Primary Examiner*—James L. Ridgill, Jr.

[57] ABSTRACT

A structural building module having longitudinal edge beams of angular S and reverse S cross-section joined together by cross-members of V cross-section and preferably including additional longitudinal reinforcing beams of Z cross-section, which modules when joined together as components of floor, wall, ceiling and roof structures define a series of interconnected roomy closed channels adapted to receive electric wiring and the like.

17 Claims, 13 Drawing Figures

CONSTRUCTION MODULE AND STRUCTURES ASSEMBLED THEREFROM

Figure 1:
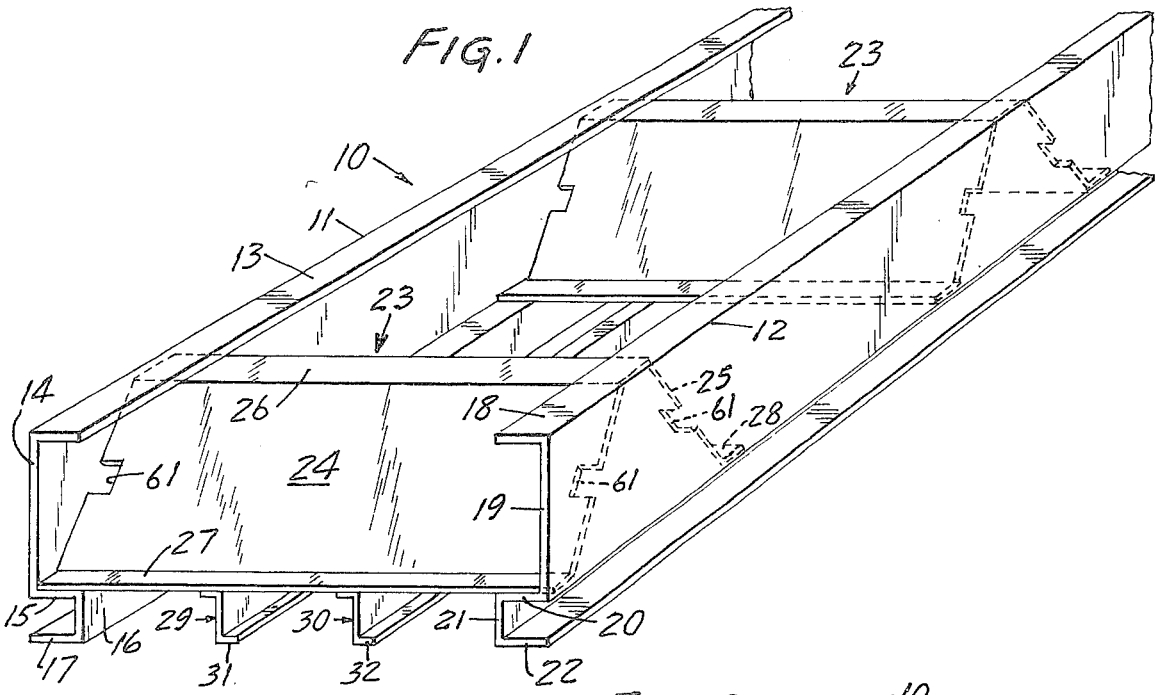

This invention relates to the construction industry and in particular to novel modular panel structure and appurtenances thereto having utility in the erection of dwellings and other buildings. In one aspect the invention relates to individual modules capable of being joined together to provide floor, wall, ceiling and roof structures. In another aspect the invention relates to modular structure, including auxiliary members, cooperatively inter-engaging to impart structural strength and rigidity while providing continuous interconnecting channels for utility connections. In a further important aspect the invention relates to modular structure permitting rapid assembly of dwellings of any desired shape using a minimum of skilled labor.

Modular building wall structures with electrical raceway means have previously been described. For example, in U.S. Pat. No. 3,529,389 each module has parallel tongue and groove side edges, any two adjacent modules then being joined together with a tongue-and-groove joint. The interior of the tongue member then may serve as a narrow channel for electrical wires.

The present invention provides a module with opposing groove-like openings and flat contact surfaces along both edges, thereby providing a greatly enlarged service run or channel, as well as a firm juncture between adjacent modules and a strongly reinforced beam structure. Other advantages will be made apparent as the description proceeds.

Figure 2:
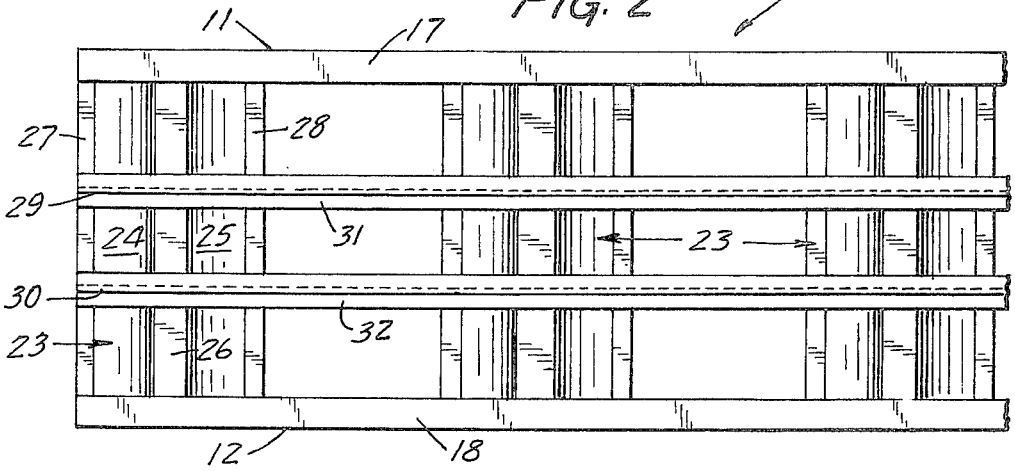
Figure 3:
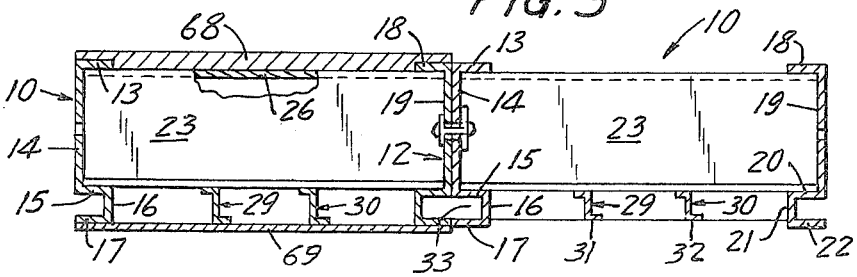
Figure 4:
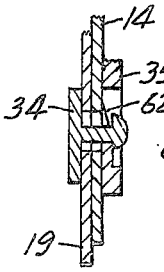
Figure 5:
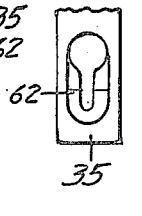
Figure 6:
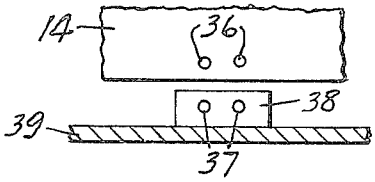
Figure 7:
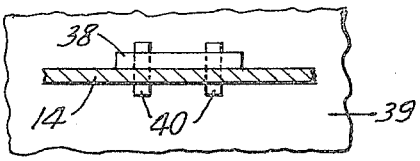
Figure 8:
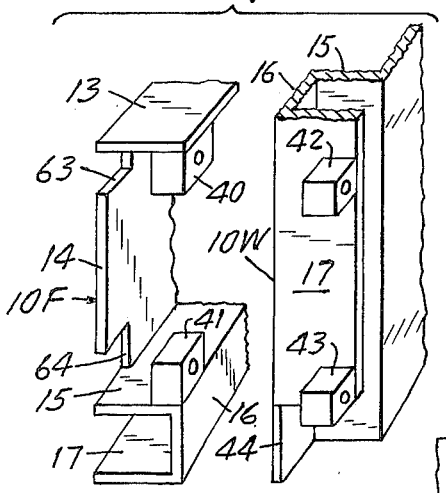
Figure 9:
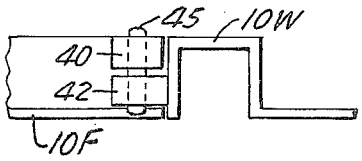
Figure 11:
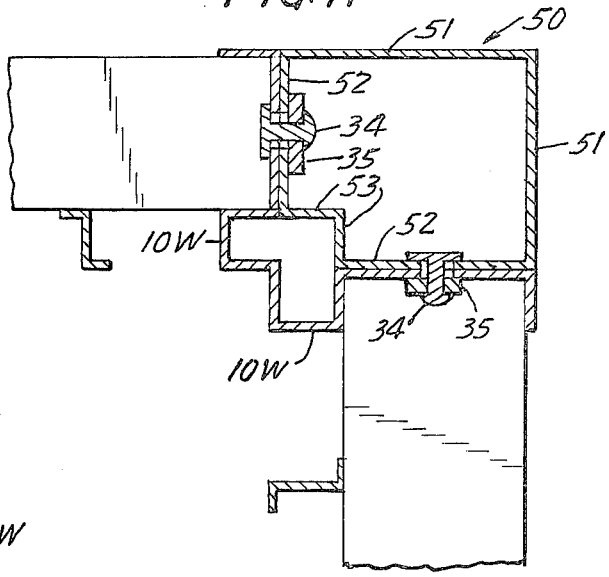
Figure 10:
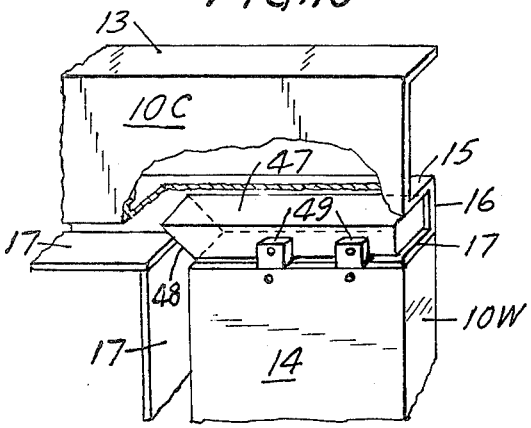
Figure 12:
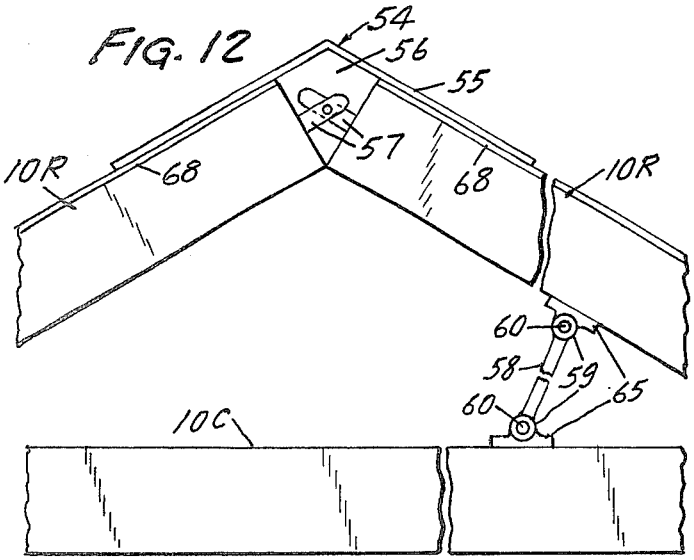
Figure 13:
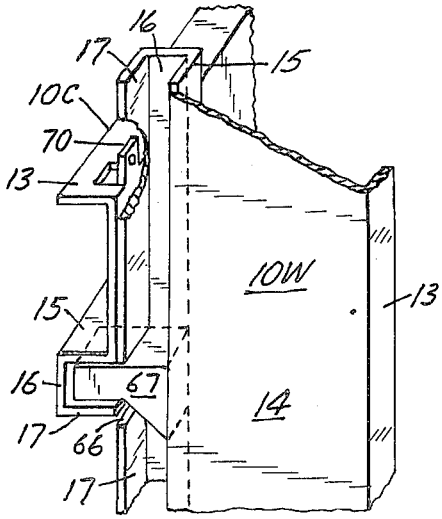

In the drawing,

FIG. 1 is a view in perspective of a portion of a typical module of the invention with portions cut away to show detail, FIG. 2 is a bottom plan view of an end portion of a module as shown in FIG. 1, FIG. 3 is an end elevation showing two modules joined together in edge-to-edge relationship, FIG. 4 is a view in section of one form of module clamp means, and FIG. 5 is a plan view of a portion of the closure member of FIG. 4, FIGS. 6 and 7 are partial elevation and plan views respectively showing a detail of typical connection means between a wall module and a floor plate, FIGS. 8 and 9 are partial perspective and plan views respectively of typical means for connecting floor and wall modules, FIG. 10 is a partial view in perspective, with portions cut away, of means for connecting wall and ceiling modules, FIG. 11 is a view in section showing means for completing an outside wall corner, FIG. 12 is a partial elevation showing roof and ceiling modules with attached peak and truss members, and FIG. 13 is a partial view in perspective, with portions cut away, of a ceiling module suspended along a wall module.

The module 10 of FIG. 1 will be seen to comprise a first longitudinal edge beam 11 of angular generally S shaped cross-section and a second longitudinal edge beam 12 of analogously reverse S shaped cross-section. Beam 11 consists of a narrow top band 13, a deep vertical panel 14, an intermediate narrow band 15, a shallow vertical panel 16, and a bottom band 17. Similarly, beam 12 consists of top band 18, upper panel 19, intermediate band 20, lower panel 21 and bottom band 22. (It will be understood that terms such as "vertical" are meant to apply to the modules and components in the positions shown in the Figures and are solely for purposes of identification). As shown in the drawing, the top, intermediate and bottom bands 13, 15, 17 are parallel to each other and to the plane of the module, and perpendicular to the panels 14, 16. The deep panel 14 joins the top and intermediate bands 13, 15 along their outer edges with respect to the module, while the shallow panel 16 joins the intermediate and bottom bands 15, 17 along their inner edges.

The two edge beams are joined by a series of inverted generally V-shaped cross members 23 disposed perpendicularly to the beams and terminating within the deep upper portions thereof, with the open side of the V facing the shallow lower portions, as shown in FIG. 1. Each cross-piece consists of angularly opposing panels 24, 25 separated by a narrow connecting strip 26 and having outwardly turned free lips 27, 28. The strip 26 rests against upper bands 13 and 18; the lips 27, 28 rest against intermediate bands 15, 20. The cross members are located at spaced regular intervals along the length of the module 10.

A space 61 is desirably provided centrally of each end of the panels 25, 24 for a purpose to be described, the ends otherwise being against the panels 14, 19 and preferably secured thereto, e.g. by welding. In an alternative but less rugged structure the ends of the panels 25, 24 are spaced from the panels 14, 19, the cross members then being secured only at the bands 13, 15 and 18, 20.

The module illustrated in FIG. 1 also includes two longitudinal reinforcing Z-beams 29, 30 uniformly spaced between the edge beams and across the open sides of the cross-pieces 23. The outer free faces 31, 32 of these beams are in the plane of the outer free faces of the bands 17, 22. In narrow modules one or both of these beams may be omitted.

It will be appreciated that the several components shown are most effectively constructed of metal and joined by welding, although other materials and procedures are not precluded. The basic module structure as described hereinbefore is readily produced to any desired dimensions as may be required. When formed of rolled steel or extruded aluminum alloy, for example, the edge beams and Z beams are well adapted to continuous manufacture of the module structure, with segments of any desired length being removed as formed.

It will further be understood that the module structure described represents the basic framework, and that any desired sheathing or covering is to be applied over the faces of said framework either prior or subsequent to the assembly of the several modules into a completed structure. As an example, one of the modules illustrated in FIG. 3 is shown sheathed over both major surfaces with decorative or protective coverings 68, 69. It will be seen that any such covering will be adequately supported by the panels 26 of the cross members 23 and by the faces 31, 32 of the reinforcing members 29, 30, the latter being appropriately spaced to provide the desired support as well as the required rigidity and structural strength. Where desired, the interior of the module may be partly or fully filled with thermal insulation, which may be applied during or subsequent to application of the surfacing.

The foregoing basic module structure is a useful structural article without further modification, as for example as a support for loading platforms or the like. For many applications various minor modifications are found desirable, such as will now be further described.

FIG. 3 illustrates a structure wherein adjacent modules 10 of FIG. 1 are rigidly attached together in edge alignment as in assembling a floor, wall or ceiling. The deep faces 14, 19 of the adjacent edge beams are held tightly together; the shallow lower portions combine to form a closed channel 33 along the full length of the structure.

One means for joining the modules 10 is illustrated in FIGS. 4 and 5. Opposing panels 19, 14 of adjacent modules are perforate to accept a headed stud 34, and a clamping member 35 fitting over the head of the stude is slid against the panel 14 with its inclined surface 62 against the inner face of the head, drawing the modules snugly together. The member 35 may be applied from an open side of the module, or may be extended to an end of the module where the sheathing has previously been applied, the cutout areas 61 in the ends of the cross members 23 permitting such positioning. Where the area is fully accessible during assembly, bolts or rivets are fully satisfactory for securing together the two modules. In other situations the stud 34 is welded or otherwise fixed in position on the panel 19 prior to assembly.

An adhesive bonding agent may optionally be spread over the contacting surfaces just prior to the clamping or securing operation, various known self-curing resinous cements being well suited for the purpose.

Vertical wall modules are fastened in place by means shown in FIGS. 6 and 7. Perforations 36 are provided adjacent the end of the panel 14 to match similar perforations 37 in an upright 38 attached to a floor plate 39 which is anchored to the foundation, and pins 40 are inserted to hold the two members together.

For joining a floor module 10F to a wall module 10W the modification shown in FIGS. 8 and 9 is found desirable. Perforate blocks 40, 41 are attached at the outer margins of bands 13 and 15, and segments of panel 14 in line with the blocks are removed to provide access openings 63, 64 as shown for the floor module 10F. Similar blocks 42, 43 are attached to band 17 of module 10W and a terminal segment of the band is removed as indicated by edge 44. The resulting opening provides for access between the channels 33F and 33W formed on mounting further modules in edge contact with those illustrated as the wall and floor structure is continued. The two modules are fitted together and held in place by pins or screws 45 as indicated in FIG. 9.

In these and related Figures it will be appreciated that only portions of pertinent edge beams have been shown, the remainder of the module structure being omitted for clarity of illustration.

FIG. 10 illustrates means for supporting an edge of a ceiling module 10C at the top of a wall module 10W. A block 47 having an angled end 48 is attached to the top of panel 14 of module 10W by means of perforate connecting lugs 49 and appropriate pins, and fits within the half channel defined by bands 15, 16, 17 of module 10C. A segment of band 17 of module 10C overlying the corresponding half channel of module 10W is removed to provide access between the two half channels. The sloping end 48 of the block serves as a guide for wires or cable later to be installed within the connecting channels. The space between the lugs 49 permits insertion of an elongate clamping member 35 as described in connection with FIGS. 4 and 5.

A corner member 50 for completing a wall corner structure is shown in FIG. 11. It consists of external panels 51, connecting panels 52, and channel-forming panels 53. The connecting panels are perforate to receive connecting studs 34 which cooperate with sliding bars 35 in forming a rigid connection between the trim element and the adjacent wall modules, as in FIGS. 4 and 5.

A gable roof structure employing roof modules 10R requires a ridge member 54 which, for example as shown in FIG. 12, consists of an open inverted V-shaped elongate cap 55 attached to perforate dependent brace plates 56 to which the several roof modules, previously provided with roofing panels 68, are attached by lugs 57 and appropriate pins.

For particularly wide roof or ceiling spans it may be desirable to include suitable bracing; and one form, shown in FIG. 12, consists of rods 58 terminating in rings 59 and attached to pins 60 of brackets 65 fastened to modules 10C and 10R.

One additional structural modification, useful in supporting a ceiling module against a gable wall, where the wall modules do not terminate at the ceiling level, remains to be described. For this purpose, as shown in FIG. 13, a segment of the band 17 of the vertical wall module 10W is removed at 66, and a supporting block 67 fastened to the band 15 of the wall module 10W extends through the opening into the half-channel defined by bands 15, 16, 17 of the ceiling module 10C. For further rigidity a flap 70 may be lifted from the top band 13 of module 10C into contact with the band 17 of module 10W and secured thereto by means of an appropriate fastening in matching apertures in flap and band.

It is to be understood that modules may be constructed to any desired dimensions as required by structural stress and rigidity considerations, and that additional modifications to any or all modules may be made as necessitated by the requirements of a particular structure. For example, openings for door and window casings, electrical outlets, plumbing and heating structures etc. are readily accommodated during initial assembly of the respective modules. The modules are easily assembled in a variety of combinations by means of the several methods and appurtenant structures described, or various modifications or combinations thereof, and either in basic framework or as insulated, covered and fully complete components.

What is claimed is as follows:

1. A structure comprising a structural module having a framework including a first longitudinal edge beam having an angular generally S shaped cross-section and a parallel second longitudinal edge beam having an angular generally reverse S shaped cross-section, each of said beams having a deep upper portion and a shallow lower portion, said beams each consisting essentially of narrow top, intermediate and bottom bands parallel to each other and to the plane of the module, and a deep and a shallow side panel perpendicular to said bands, said deep panel joining said top and intermediate bands along their outer edges and said shallow panel joining said intermediate and bottom bands along their inner edges, said beams being interconnected by spaced cross-members perpendicular thereto terminating within said deep portions and having a V shaped cross-section with the open side of the V facing said lower portion.

2. Structure of claim 1 wherein said module is sheathed over at least the surface defined by the closed ends of the V-shaped cross-members.

3. Structure of claim 1 wherein the ends of said cross-members of said module contact and are joined to the deep vertical panels of said upper portion of said edge beams.

4. Structure of claim 1 wherein at least a central portion at the ends of each leg of each of said V-shaped cross-members is spaced from the deep vertical panel of said upper portion to provide an open passage centrally along each said panel.

5. Structure of claim 1 wherein said module includes at least one longitudinal reinforcing Z-beam attached across the open faces of said cross-members and extending to the plane of the bottoms of said edge beams.

6. Structure of claim 5 wherein are included two said Z-beams uniformly disposed between said first and second edge beams.

7. Structure of claim 3 wherein said module is sheathed over both major surfaces.

8. Structure of claim 1 wherein the deep panel of each said edge beam of said module is perforate adjacent at least one end of said panel.

9. Structure of claim 8 wherein a plurality of said modules are fastened together in edge-to-edge relationship and are each fastened to a floor plate having an upright block perforated to correspond with the perforations in said deep panels.

10. Structure of claim 1 wherein a first said module is fastened to a second said module disposed at right angles thereto in floor-to-wall relationship.

11. Structure of claim 10 wherein said modules are fastened together by means of a first pair of perforate blocks attached adjacent the outer edge of the bottom band of an edge beam of said first module and a second pair of similar blocks attached adjacent the inner edges of the top and intermediate bands of an edge beam of said second module, in alignment with the blocks of said first pair, and a connecting pin through each set of aligned blocks; the end portion of the bottom band of the edge beam of said first module being removed to provide a continuous passage between the shallow lower portions of said edge beams.

12. Structure of claim 10 wherein said first module carries a block attached, within the shallow lower portion of a said edge beam, to the intermediate band of said beam and extending outwardly through an opening in the bottom band of said beam and into the shallow lower portion of an edge beam of the second said module.

13. Structure of claim 1 wherein said module is provided at each of said edge beams with fastening means for attaching another said module in edge-to-edge relationship.

14. Structure of claim 13 wherein said fastening means includes at one of said beams an extended headed stud member and the other of said beams is perforate to receive a said stud member in position for sealing to a said one beam of an adjacent module.

15. Structure of claim 13 wherein are included a plurality of said modules fastened together in edge-to-edge relationship and providing closed channels between shallow lower portions of adjacent edge beams.

16. Structure of claim 15 wherein the modules of said plurality of modules are each fastened to a corresponding module of a second said plurality in end-to-end angular relationship through an intervening brace plate to which is atttached an elongate cap having an inverted V cross-section and covering the open side of the space intervening between the adjacent ends of the said pluralities of modules.

17. Structure of claim 15 wherein the end module of said plurality of modules is fastended along its free edge to one face of a hollow corner post of generally square cross-section, to an adjacent face of which is fastened the free edge of a second said plurality of modules.

* * * * *